US006502522B1

(12) United States Patent
Doleski et al.

(10) Patent No.: US 6,502,522 B1
(45) Date of Patent: Jan. 7, 2003

(54) COIL RESTRAINT DEVICE

(75) Inventors: Robert F. Doleski, Middletown; Anthony V. Raffa, Newport, both of RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/226,619

(22) Filed: Dec. 21, 1998

(51) Int. Cl.[7] ..... F42B 19/01
(52) U.S. Cl. ..... 114/21.2; 244/3.12
(58) Field of Search ..... 242/593, 597.4, 242/3.11; 244/3.12; 114/21.2, 21.1

(56) References Cited

U.S. PATENT DOCUMENTS 4,573,647 A * 3/1986 Laten et al. ..... 244/3.12
4,903,607 A * 2/1990 Clark ..... 102/504
5,022,607 A * 6/1991 Schotter ..... 244/3.12
5,031,997 A * 7/1991 Redford et al. ..... 350/96.23
5,056,406 A * 10/1991 Pinson ..... 89/1.816
5,181,270 A * 1/1993 Hsu et al. ..... 385/134
5,520,346 A * 5/1996 Hoban ..... 242/128
5,637,825 A * 6/1997 Glenning ..... 114/21.1
5,678,785 A * 10/1997 Porter ..... 244/3.12
5,720,448 A * 2/1998 Foulsham et al. ..... 244/3.12

* cited by examiner

*Primary Examiner*—Michael J. Carone
*Assistant Examiner*—Denise J Buckley
(74) *Attorney, Agent, or Firm*—Michael J. McGowan; Robert W. Gauthier; Prithvi C. Lall

(57) ABSTRACT

A coil restraint device for a torpedo mounted dispenser of a torpedo assembly is disclosed. The torpedo assembly includes at least a torpedo body, a longitudinal propulsion shaft housed within the torpedo body, and a torpedo mounted dispenser connected to the longitudinal propulsion shaft at the aft end of the torpedo body. The torpedo mounted dispenser houses a wire payout coil and a flex hose surrounds the wire payout coil, a forward end of the flex hose being open and unrestrained. The coil restraint device includes a flexible band member having an inner surface, an outer surface, opposite ends, and opposing longitudinal edges. A strap is provided on the outer surface of the flexible band member, the strap having opposite distal ends extending beyond a length of the flexible band member. A securing connection is provided for securing the opposite distal ends of the strap together, thereby forming the flexible band member into a circular shape around the torpedo assembly with one edge of the flexible band member abuting the flex hose of the tail mounted dispenser upon engagement of the securing connection.

18 Claims, 3 Drawing Sheets

COIL RESTRAINT DEVICE

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

This invention generally relates to a coil restraint device. More particularly, the invention relates to a coil restraint device which maintains coils of a tail mounted dispenser in place during shock to or transport of the tail mounted coils.

(2) Description of the Prior Art

Heavy weight torpedoes such as the MK48, MK48/ADCAP, and MK48/ADCAP/TPU, contain wire payout communication systems. A complete ADCAP war-shot torpedo propulsion layout 10 is shown in FIG. 1. This assembly 10 includes at least a torpedo body 12 having a propulsor shaft 14 longitudinally formed therein. The torpedo body 12 includes a forward end 16 and an aft end 18 to aid in the description of related components. Adjacent the aft end 18 of the torpedo body 12 is a bell mouth adapter 20 in connection with an aft end of the propulsor shaft 14. A torpedo mounted dispenser 22 is attached to the aft 18 end of the torpedo body 12 with the bell mouth adapter 20.

The torpedo mounted dispenser 22 contains a wire payout coil 24, and a flex hose 26 is wrapped around the actual wire payout coil 24. A wire torpedo payout coil (not shown) is contained in the forward end 16 of the torpedo body 12 in addition to the wire payout coil 24 in the torpedo mounted dispenser 22. When the torpedo body 12 is launched from within a submarine's torpedo tube, the torpedo mounted dispenser 22 remains within the torpedo tube. The wire torpedo payout coil in the torpedo body 12 pays out when the vehicle is launched as does the wire payout coil 24 in the torpedo mounted dispenser 22 by feeding through the flex hose 26 extended out under the submarine. In other words, the torpedo mounted dispenser 22 contains the coiled weighted flexible tube 26 through which the wire torpedo payout coil 24 passes.

The torpedo mounted dispenser 22 includes a mounting face 28 in front of the wire payout coil 24 and an open face 30 annularly surrounding the mounting face 28 and in front of a flex hose cavity 32 such that the open face 30 does not in any way contain the flex hose coil 26, since the flex hose coil 26 within the flex hose cavity 32 annularly surrounds the wire payout coil 24 of the tail mounted dispenser 22. Also at the aft end 18 of the torpedo body 12 is a shroud 34 which defines a transition between the tail mounted dispenser and the aft end of the torpedo body 12.

The inventors have, therefore, discovered a problem that during storage, transportation, and towage in the torpedo room with the torpedo mounted dispenser 22 attached to the torpedo body 12, the flex hose coil 26 can be spilled out of open annular face 30 of the tail mounted dispenser 22 as a result of shock and vibration. This can also occur during shock and vibration testing in the laboratory. Currently, the forward surface of the flex hose coil 26 is restrained only by an O-ring (not shown) that ensures the flex hose pays out properly. Once the system is loaded into a torpedo tube, no restraint besides the O-ring system is needed or desired in any case. The torpedo mounted dispenser 22 remains attached to the tube door and the vehicle is free to be launched separately. Accordingly, a need in the art exists for securement of the forward surface of the flex hose, particularly during transportation, storage, and towing of the torpedo.

The following patents, for example, disclose caps and related securing devices in association with torpedoes, but do not disclose a coil restraint device as in the present invention.

U.S. Pat. No. 3,069,975 to Nauschutz et al.;
U.S. Pat. No. 3,158,124 to Chevillon;
U.S. Pat. No. 5,179,612 to Rochester et al.;
U.S. Pat. No. 5,189,253 to LeCompte;
U.S. Pat. No. 5,362,014 to Sandham;
U.S. Pat. No. 5,678,785 to Porter; and
U.S. Pat. No. 5,637,825 to Glenning.

The patent to Nauschutz et al. discloses a removable cover for protecting a coil of line at the tail end of a missile. More specifically, Nauschutz et al. disclose a protective means for rocket-driven missiles, and particularly to protective means employable for missiles of the type which are guided to the target by operation of a person who remains on the launching site. The rear end of the fuselage for the missile is closed by means of a removable cover provided with locking elements to lock protective caps, which cover the trajectory control devices in their effective position. The cover has a moisture proof duct on the outwardly facing side, which serves as a multiple threaded pipe into which a connecting piece or handle is screwed. The inwardly facing side of the cover is in the form of a coil which receives the individual layers of the connecting lines and cables, combined into a compound line, for storage inside the missile. The caps protect all elements of the missile which are particularly sensitive to mechanical deformation or contamination.

The patent to Chevillon discloses a missile launching apparatus in which a sabot encircles or protects a coil of wire that is to be paid out at launch. In particular, the reel or spool of wire which was previously attached to the aft portion of the launching framework, is instead frangibly secured to the rear of the torpedo itself. The reel is enclosed within a sabot which, in effect, is merely a box or housing for the wire, and which rides along one of the longitudinal rails of the framework. When the missile is launched, the sabot containing the coil of wire follows the missile along the framework until the forward portion of the launching unit is reached. At this point, the sabot encounters a restraining member which terminates its forward movement and causes it to break away from the torpedo. The wire within the sabot then unwinds from its reel in the same manner as it would have done if the sabot had remained at the aft portion of the launching unit. However, since the sabot is now at the front portion of the launcher, the wire which unwinds therefrom is completely free of the launching framework and is in no danger of becoming entangled therein or of being abraded by contact therewith.

Rochester et al. disclose an optical fiber payout canister having a forwardly-disposed annular rounded surface that protects the fiber in its coiled orientation. The optical fiber payout canister comprises a bobbin upon which an optical fiber is wound. A shroud overlies the bobbin, and a layer of an ablative material is coated onto at least a portion of the inside wall of the shroud adjacent to the bobbin, so that the optical fiber may contact the ablative material during payout. Desirably, the ablative material has a hardness equal to or less than that of the buffer layer of the optical fiber. In one embodiment, the ablative material has a composition similar to that of the polymer buffer layer, such as an urethane acrylate. The ablative material removes energy from the optical fiber during payout, and in particular reduces the circumferential component of the energy, permitting the optical fiber to be dispensed through a dispensing opening in an end wall of the shroud.

LeCompte discloses a missile's filament dispenser. The forward portion of the filament coil is held in place by an annular flange. Specifically, a filament dispenser for a missile data link has a bobbin with end flanges fixedly mounted to the missile. A shroud is spaced opposite the filament pack for frictionally engaging a ballooning filament during dispensing to reduce ballooning amplitude. A second version passes the dispensed filament back through an opening in the bobbin for reverse dispensing. A third version is similar to the first version and, in addition, on leaving the bobbin filament passes through a relatively small diameter ring. In a fourth version, similar to the second version, the filament passes through a constraining ring located within the bobbin opening. In a final version the filament dispensed from a pack passes around a curved end flange then back over a curved surface and through an opening forming two balloons and helix elimination.

The patent to Sandham discloses an ejectable foam cover for retraining a spool of optical fiber prior to payout. In particular, a lightweight, ejectable cover assembly for a fiber optic cable payout system comprises a foam plastic cover, one or more nylon bolts, one or more compression springs, and one or more parachute reefing line cutters for severing on command the nylon bolts to cleanly eject the cover without any debris damaging the optical fiber as it pays out. A disk shaped cover covers an aircraft wing-mounted payout canister and its enclosed spool of optical fiber. A reefing line cutter or cutters severs the nylon bolt or bolts and the compression springs then forcibly eject the cover into the air stream out the way of the paying out loop of optical fiber.

Porter discloses a fiber-optic cable dispenser for a missile or torpedo. Fiber-optic cable is wound on a cylindrical bobbin without adhesive and is situated in the vehicle so that the cable, attached to a relatively stationary control computer station, is pulled freely off of the bobbin as the vehicle, such as a missile or torpedo, travels rapidly away from the station. In one embodiment, a propulsion engine is located within the hollow interior of the bobbin and the cable flows outwardly in a helix around the plume of the engine.

Glenning discloses a control line deployment device for an underwater vehicle. The device consists of a stator positioned at an aft end of an underwater vehicle having a spool bucket formed therein with an entrance opening at an aft end of the stator in communication with the spool bucket. The control line spool is slidably disposed in the spool bucket with a control line in communication with the underwater vehicle wound upon the control line spool. The control line is deployable from the control line spool by extension through the entrance opening. Access to the control line spool for its replacement is readily provided and made possible by a removable cover positioned and releasably fitted onto the entrance opening at the aft end of the stator in communication with the spool bucket. The control line deployment device in the invention facilitates installation and replacement of the spool in an underwater vehicle without requiring substantial disassembly of the underwater vehicle and without the need for cumbersome and costly infrastructure in the launch vessel.

It should be understood that the present invention would in fact enhance the functionality of the above patents by providing a manually removable coil restraint, as such a device is neither contemplated nor suggested by the prior art.

SUMMARY OF THE INVENTION

Therefore it is an object of this invention to provide a coil restraint device for securing a wire payout coil of a torpedo mounted dispenser.

Another object of this invention is to provide a coil restraint device for securing a flexible hose of a wire payout coil of a torpedo mounted dispenser.

Still another object of this invention is to provide a coil restraint device for a flexible hose of a torpedo mounted dispenser which includes a flexible band member surrounding a portion of a torpedo shroud and confronting an exposed face of the flexible hose.

A still further object of the invention is to provide a coil restraint device for a flexible hose of a torpedo mounted dispenser which includes a flexible band member and securing straps.

Yet another object of this invention is to provide a coil restraint device for a torpedo mounted dispenser which is simple to manufacture and easy to use.

In accordance with one aspect of this invention, there is provided a coil restraint device for a torpedo mounted dispenser of a torpedo assembly. The torpedo assembly includes at st a torpedo body, a longitudinal propulsion shaft housed within the torpedo body, and a torpedo mounted dispenser connected to the longitudinal propulsion shaft at the aft end of the torpedo body. The torpedo mounted dispenser houses a wire payout coil and a flex hose surrounds the wire payout coil, a forward end of the flex hose being open and unrestrained. The coil restraint device includes a flexible band member having an inner surface, an outer surface, opposite ends, and opposing longitudinal edges. A strap is provided on the outer surface of the flexible band member, the strap having opposite distal ends extending beyond a length of the flexible band member. A securing connection is provided for securing the opposite distal ends of the strap together, thereby forming the flexible band member into a circular shape around the shroud of the torpedo assembly with one edge of the flexible band member abuting the flex hose of the torpedo mounted dispenser upon engagement of the securing connection.

BRIEF DESCRIPTION OF THE DRAWINGS

The appended claims particularly point out and distinctly claim the subject matter of this invention. The various objects, advantages and novel features of this invention will be more fully apparent from a reading of the following detailed description in conjunction with the accompanying drawings in which like reference numeral refer to like parts, and in which:

DESCRIPTION OF THE PREFERRED EMBODIMENT

Figure 2:
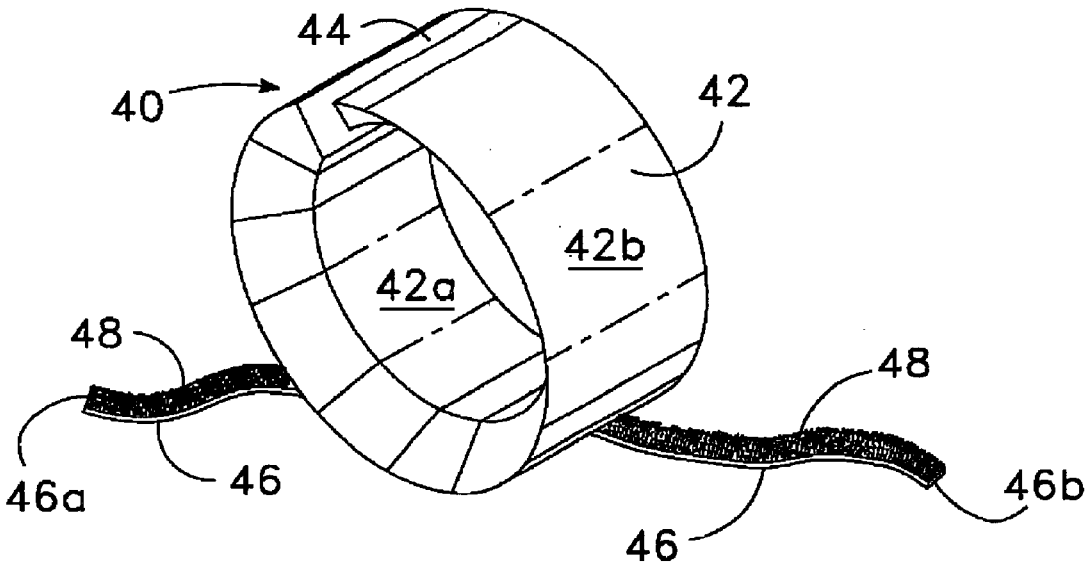
FIG. 2 is side perspective view of a torpedo mounted dispenser coil restraint for use with the known war-shot propulsor according to a first preferred embodiment of the present invention.
Figure 3:
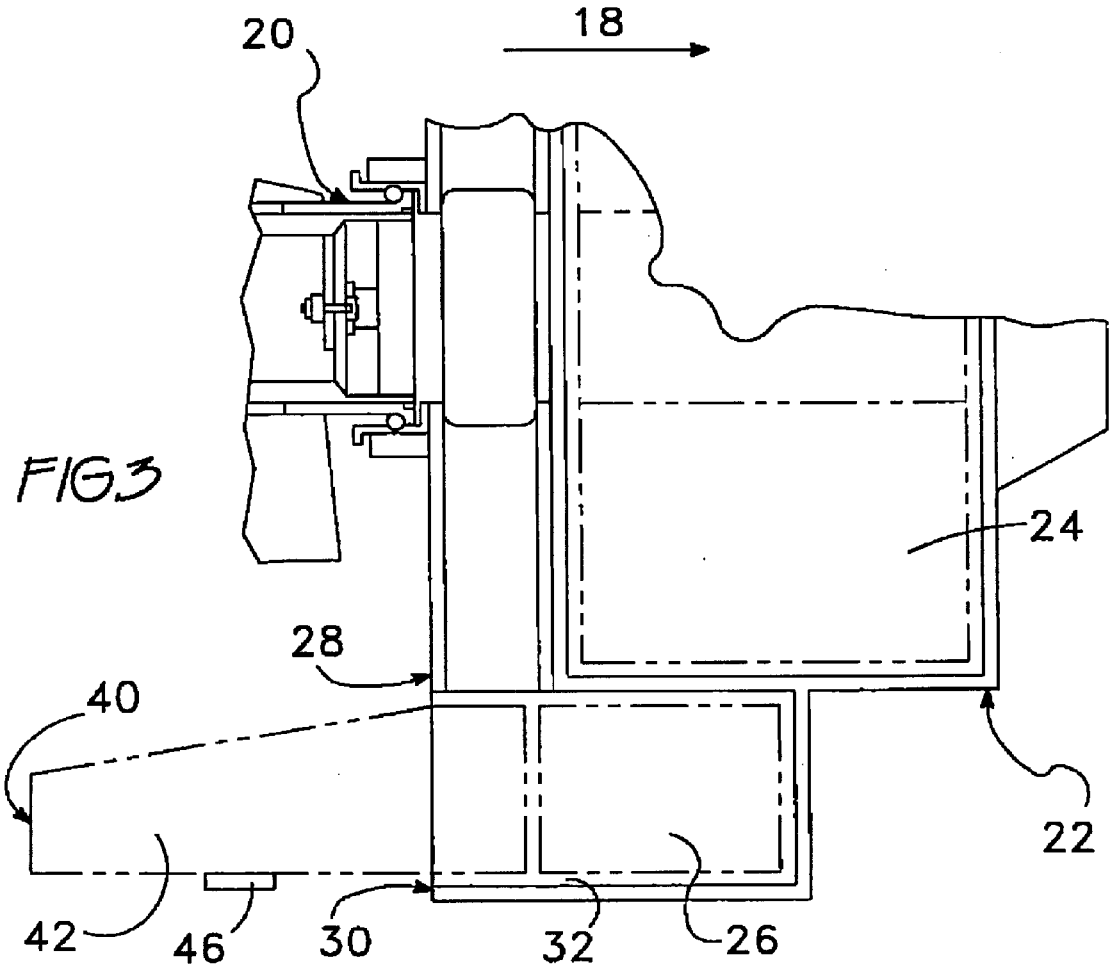
FIG. 3 is a side view of the torpedo mounted dispenser coil restraint shown in FIG. 2 mounted to a torpedo bellmouth according to the present invention.

In general, the present invention is directed to a coil restraint device 40 as shown in FIG. 2, for use with tube mounted payout coil 24 shown in further detail in FIG. 3. Finally, the complete assembly as it applies to the torpedo system is illustrated in FIG. 4.

Figure 1:
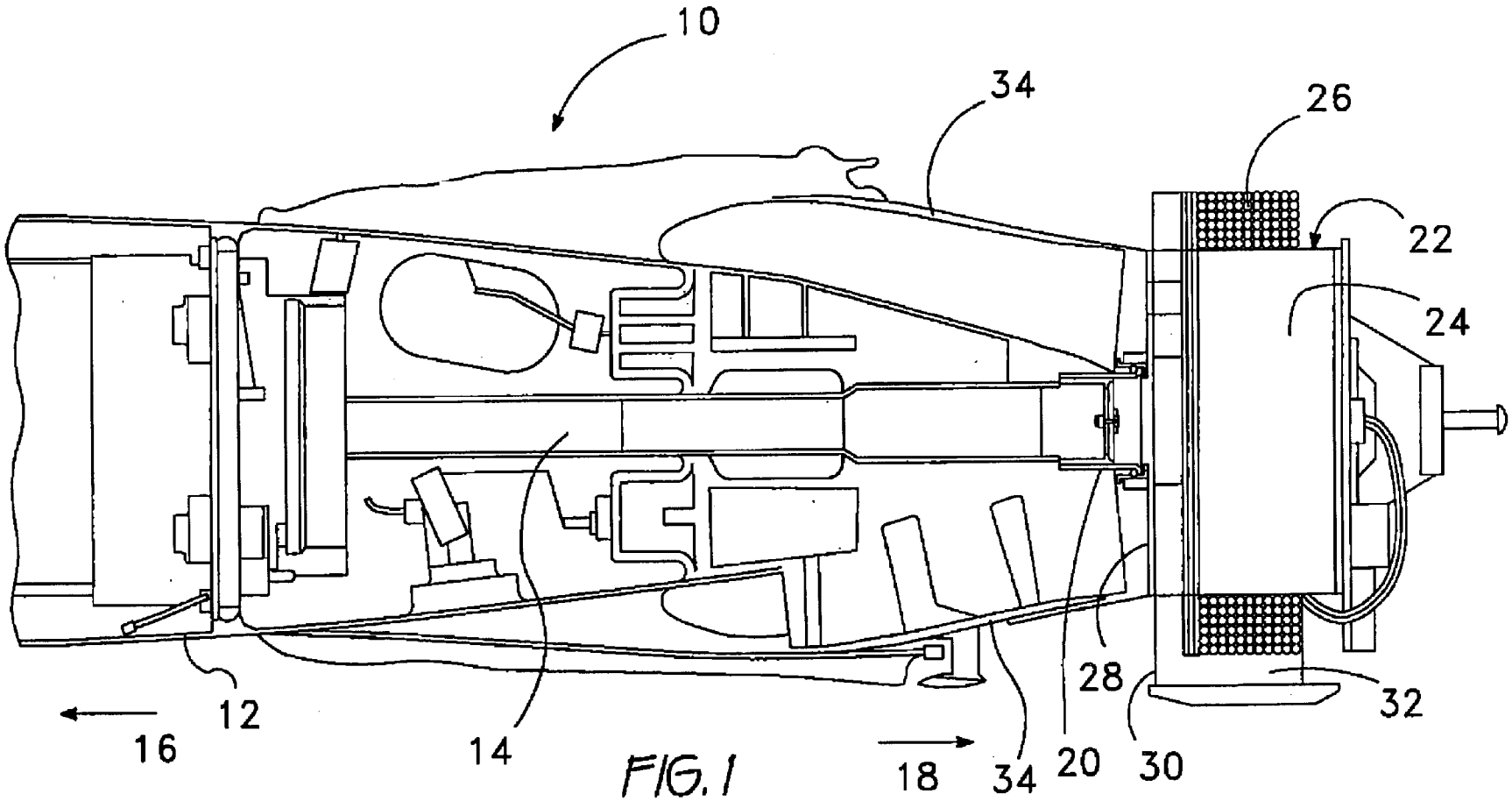
FIG. 1 Prior Art
FIG. 1 is a side view of an ADCAP war-shot propulsor layout according to the prior art.

Referring first to FIG. 2, it is desired that the flex hose 26 in the torpedo mounted dispenser 22 as described in the prior art FIG. 1 have the capability of being restrained in a simple and reliable fashion. The coil restraining ice 40 consists of a flexible band member 42 having an inner surface 42*a* and an outer surface 42*b*, and a split therein at 44. The flexible band member 42 contains the longitudinal slot or split 44 in the foam material in order to open the flexible band 42 and assemble it onto the propulsion unit 14 of the torpedo. A strap 46 is connected to the split band member 42 on the outer surface 42*b* thereof. The strap 46 may either be formed as a single length of strap or a pair of strap members. In any event, a portion of the single strap or first ends of the pair of straps are secured to the split band member 42 such that distal ends 46*a*, 46*b* of either the single strap or the pair of straps extend a distance beyond a length of the outer surface 42*b* of the flexible split band member 42 to secure the distal ends 46*a*, 46*b* of the strap or straps together when the split band member 42 is encircled around the torpedo shroud 34. It is contemplated that the connection of the distal ends 46*a*, 46*b* of the strap 46 or straps will include a hook and pile type fastener 48, marketed under the trade name of VELCRO. However, any well known, suitable and secure fastener may be used for fastening the distal ends 46*a*, 46*b* of the strap(s) 46, such as a buckle or the like. Further, as an alternative, it is assumed that some applications of the strap(s) 46 in combination with the flexible split band 42 will not require that the strap(s) 46 be physically attached to the flexible split band member 42. Instead, the act of fastening the strap around the flexible split band member 42 may be sufficient to prevent displacement of the strap 46 with respect to the split band 42.

Turning now to FIG. 3, a close-up view of a portion of the torpedo mounted dispenser 22 attached to an improved bell mouth adapter 20 with the coil restraint 40 in place is shown. More specifically, the torpedo mounted dispenser 22 is attached to the torpedo with the bell mouth adapter 20. The flexible band member 42 of the coil restraint 40 of the torpedo mounted dispenser 22 is capable of being used at any time the torpedo mounted dispenser 22 is attached to the torpedo. The coil restraint 40 is positioned on the aft end 18 of the torpedo between the torpedo shroud 34 (shown in FIG. 1) and the forward open annular face 30. Once positioned, the flexible band member 42 is held in place with the described strap(s) 46. An aft end of the flexible band member 42 is in contact with a forward surface of the flex hose coil 26. The inside forward surface of the flexible band member 42 is compressed against an aft part of the propulsor shroud 34 and the flexible band member 42 is secured onto the assembly using the velcro or buckle type strap 46. Both the strap 46 and flexible band member 40 are removed as desired and before moving the vehicle into the launch tube.

Figure 4:
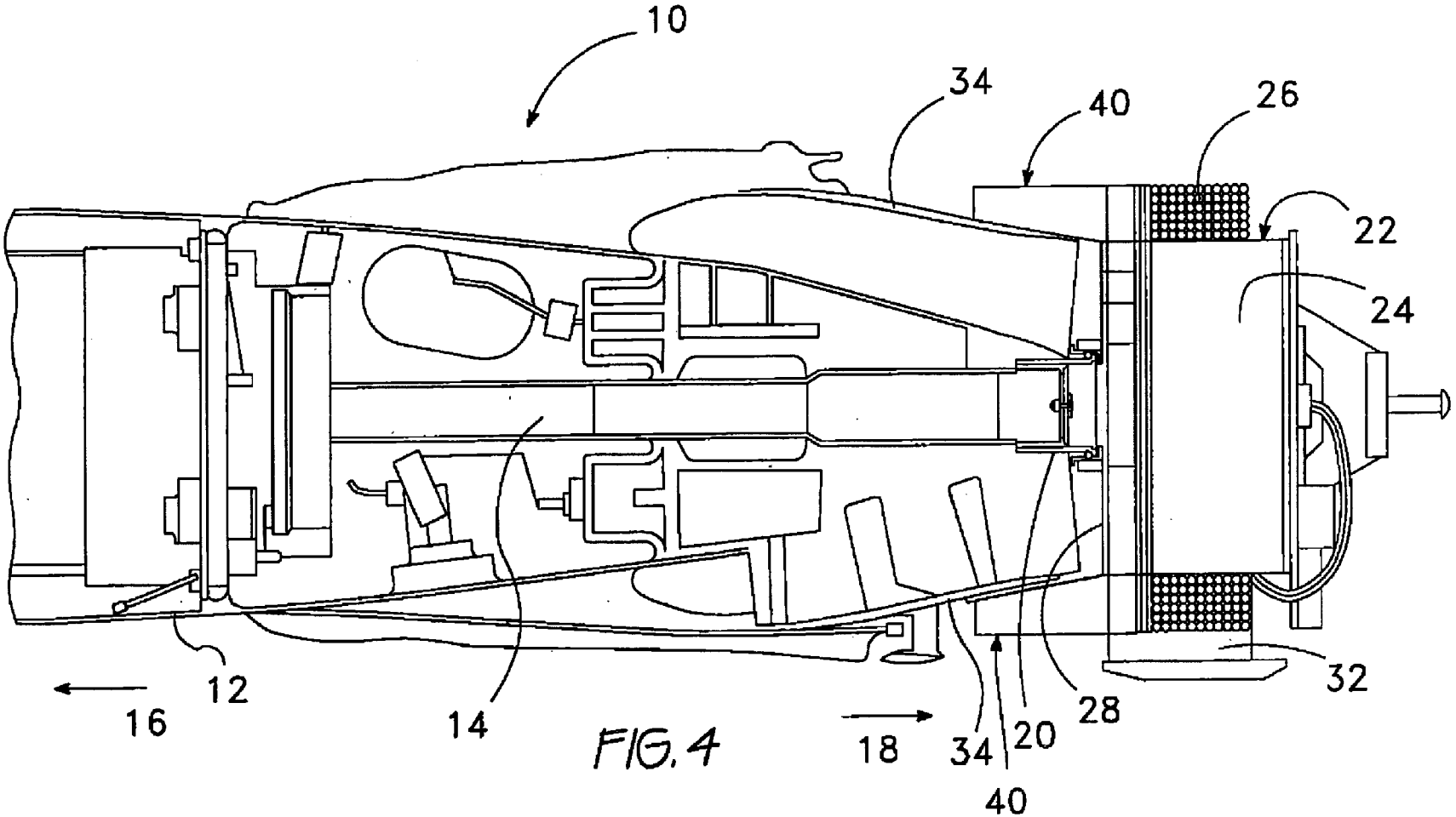
FIG. 4 is a side view of the ADCAP war-shot propulsor layout of FIG. 1 with the addition of the inventive torpedo mounted dispenser coil restraint.

The complete ADCAP war-shot propulsion assembly 10 with the attached torpedo mounted dispenser 22 and coil restraint device 40 is shown in FIG. 4. It can be seen that the coil restraint device 40 is simple to place and provides an effective result not previously known in the art. There is no restraint band device available for fleet use at this time. It has been found by the inventors that the restraint device works well under actual storage and transport circumstances. The described device is an extremely simple flexible structure that will provide the necessary restraint for the flex hose.

Alternatives primarily reside in the use of different materials as well as simplified molding or cutting processes for producing final designs. At the present, it is contemplated that the coil restraint device 40 will usually be formed using simple commercial off-the shelf foam flat stock. This foam flat stock requires little fabrication other than cutting. A smoother fit could be obtained by forming a chamfer on the inner peripheral surface 42*a* of the flexible band member 42 of the coil restraint device 40 to better conform to the outer diameter of the torpedo propulsor shroud 34. The flexible band member 42 of the coil restraint device 40 could also be molded into a circular shape rather than making it from flat stock. Alternate materials such as light weight closed or open celled foams such as polyurethane, polypropylene, or other material compatible and approved for on-board submarine use may be used. The strap(s) 46 could be made from a variety of material also. The strap(s) 46 may also be made to be retained on the flexible band member 42 as a pre-formed assembly.

By the present invention, a coil restraint device for a torpedo mounted dispenser is disclosed which secures the flex tube of the torpedo mounted dispenser in an efficient manner using a device that has not previously been disclosed in the art.

This invention has been disclosed in terms of certain embodiments. It will be apparent that many modifications can be made to the disclosed apparatus without departing from the invention. Therefore, it is the intent of the appended claims to cover all such variations and modifications as come within the true spirit and scope of this invention.

What is claimed is:

1. A coil restraint device for a torpedo mounted dispenser of a torpedo assembly, said coil restraint device comprising:

a flexible band member including an inner surface and an outer surface;

at least one strap provided on the outer surface of said flexible band member, said at least one strap member having opposite distal ends; and a securing connection for securing the opposite distal ends of said at least one strap together, thereby forming said flexible band member into a circular shape upon engagement of said securing connection.

2. The coil restraint device according to claim 1 wherein said flexible band member includes chamfered longitudinal edges on the inner surface thereof, the inner surface conforming to a shape of the torpedo assembly when the flexible band member is place radially about the torpedo assembly.

3. The coil restraint device according to claim 1 wherein said flexible band member is formed of a foam material.

4. The coil restraint device according to claim 1 wherein said at least one strap is a single strap.

5. The coil restraint device according to claim 4 wherein said single strap is connected to the outer surface of said flexible band member.

6. The coil restraint device according to claim 4 wherein said single strap is formed independently of the outer surface of said flexible band member.

7. The coil restraint device according to claim 1 wherein said securing connection is a hook and pile fastener at the distal ends of said at least one strap.

8. The coil restraint device according to claim 5 wherein said securing connection is a hook and pile fastener at the distal ends of said at least one strap.

9. The coil restraint device according to claim 1 wherein said at least one strap is a pair of straps with first ends of said pair Of straps connected to the outer surface of said flexible band member and remaining ends extending beyond a length of said flexible band member.

10. A coil restraint device for a torpedo mounted dispenser of a torpedo assembly, the torpedo assembly including at least a torpedo body having a forward end and an aft end, a longitudinal propulsion shaft housed within the torpedo body, a torpedo mounted dispenser connected to the longitudinal propulsion shaft at the aft end of the torpedo body, the torpedo mounted dispenser housing a wire payout coil and a flex hose surrounding the wire payout coil, a forward end of the flex hose being open and unrestrained, and a shroud defining a transition between the tail mounted dispenser and the torpedo body, the improvement comprising:

a flexible band member including an inner surface, an outer surface, opposite ends, and opposing longitudinal edges;

at least one strap provided on the outer surface of said flexible band member, said at least one strap member having opposite distal ends extending beyond a length of said flexible band member; and a securing connection for securing the opposite distal ends of said at least one strap together, thereby forming said flexible band member into a circular shape around the shroud of said torpedo assembly with one edge of said flexible band member abuting the flex hose of said tail mounted dispenser upon engagement of said securing connection.

11. The coil restraint according to claim 10 wherein said flexible band member includes chamfered longitudinal edges on the inner surface thereof, the inner surface conforming to a shape of the shroud when the flexible band member is place radially about the shroud.

12. The coil restraint device according to claim 10 wherein said flexible band member is formed of a foam material.

13. The coil restraint device according to claim 10 wherein said at least one strap is a single strap.

14. The coil restraint device according to claim 13 wherein said single strap is connected to the outer surface of said flexible band member.

15. The coil restraint device according to claim 13 wherein said single strap is formed independently of the outer surface of said flexible band member.

16. The coil restraint device according to claim 10 wherein said securing connection is a hook and pile fastener at the distal ends of said at least one strap.

17. The coil restraint device according to claim 14 wherein said securing connection is a hook and pile fastener at the distal ends of said at least one strap.

18. The coil restraint device according to claim 10 wherein said at least one strap is a pair of straps with first ends of said pair of straps connected to the outer surface of said flexible band member and remaining ends extending beyond a length of said flexible band member.

* * * * *